US008208674B2

(12) United States Patent
Lyon

(10) Patent No.: US 8,208,674 B2
(45) Date of Patent: Jun. 26, 2012

(54) SQUEEZE-STRETCH DRIVER FOR EARPHONE AND THE LIKE

(75) Inventor: Richard H. Lyon, Belmont, MA (US)

(73) Assignee: RH Lyon Corp, Belmont, MA (US)

( * ) Notice: Subject to any disclaimer, the term of this patent is extended or adjusted under 35 U.S.C. 154(b) by 1344 days.

(21) Appl. No.: 11/805,174

(22) Filed: May 22, 2007

(65) Prior Publication Data

US 2007/0274558 A1 Nov. 29, 2007

Related U.S. Application Data

(60) Provisional application No. 60/802,587, filed on May 23, 2006.

(51) Int. Cl.
*H04R 25/00* (2006.01)

(52) U.S. Cl. ..... 381/380; 381/328

(58) Field of Classification Search ..... 381/23.1, 381/312, 317, 318, 328, 71.6, 380; 181/163
See application file for complete search history.

(56) References Cited

U.S. PATENT DOCUMENTS 4,109,116 A 8/1978 Victoreen
5,600,729 A * 2/1997 Darlington et al. ..... 381/71.6

OTHER PUBLICATIONS

Guillemin, E.A., *Introductory Circuit Theory*, Chapman & Hall, Ltd., New York, 1953, pp. 153-161.

SBIR report #1, Advanced Subminiature Loudspeaker/Earphone Driver, submitted by RH Lyon Corp under contract No. PO #FA8650-05-M-6572. This document is not admitted to be prior art. It was submitted to the addressees on Jun. 17, 2005 pursuant to various Federal Acquisition Regulations, including, but not limited to 52.227-11, and Defense Federal Acquisition Regulation Supplement contract clauses, including, but not limited to 252.204-7000; 252.227-7018; 252.227-7034; 252.227-7039.

* cited by examiner

*Primary Examiner* — Tuan Nguyen
(74) *Attorney, Agent, or Firm* — Steven J. Weissburg

(57) ABSTRACT

A squeeze-stretch (also called, herein push-pull) loudspeaker or driver, such as an electret, can operate in an active noise reduction (ANR) earplug application. Other embodiments of a squeeze-stretch loudspeaker, such as piezoelectric bimorph and balanced armature, operate in a similar way, although they will differ in detail. Other applications, such as earphones for communication and entertainment, will benefit from the compact arrangement of components in a squeeze-stretch design. The advantages are a greater sound output from a smaller package, a smooth frequency response, and because of the diaphragm arrangement, less sensitivity to vibration.

20 Claims, 16 Drawing Sheets

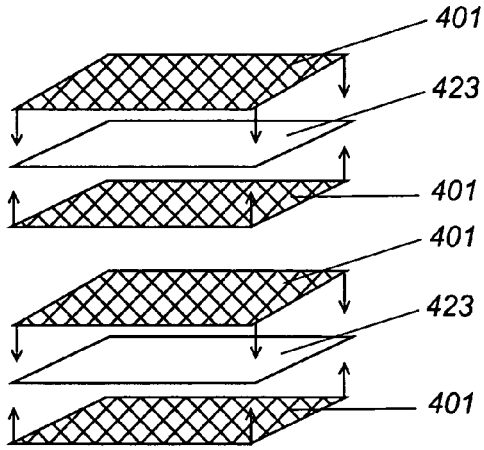
*Fig. 4A.I*
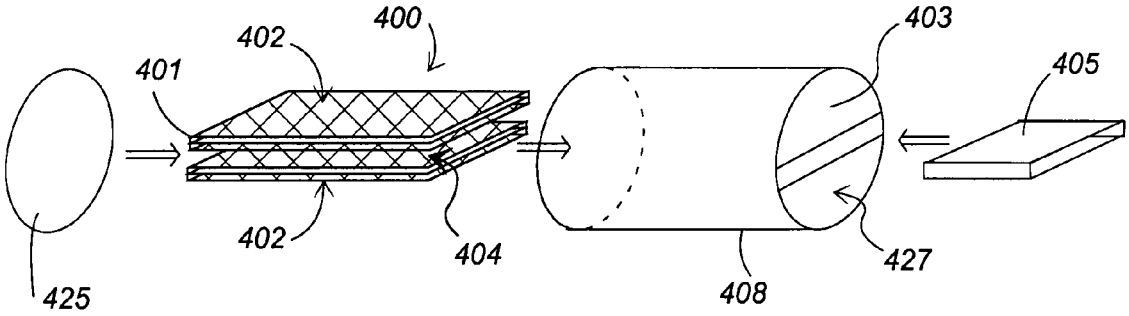
*Fig. 4A.II*
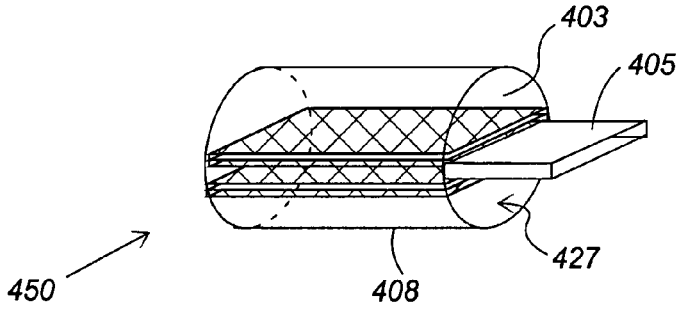
*Fig. 4A.III*

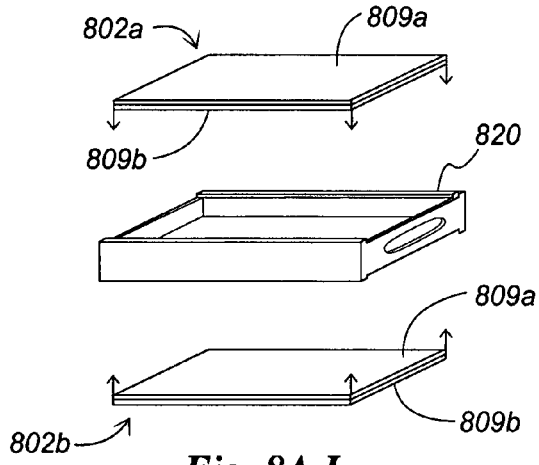
*Fig. 8A.I*
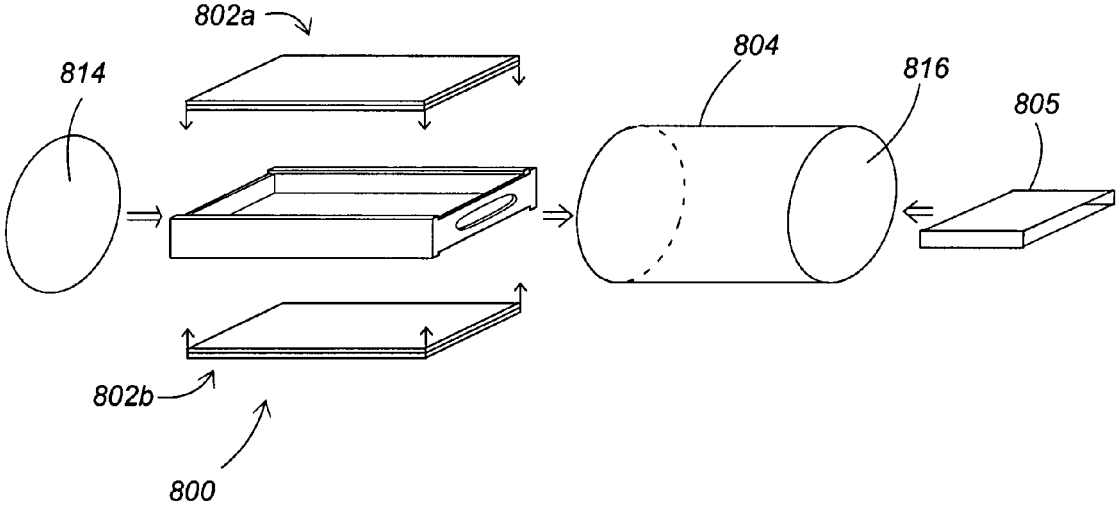
*Fig. 8A.II*
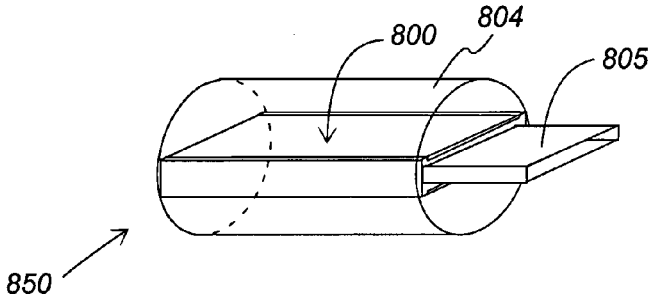
*Fig. 8A.III*

SQUEEZE-STRETCH DRIVER FOR EARPHONE AND THE LIKE

RELATED DOCUMENTS

The benefit of U.S. Provisional application No. 60/802,587, filed on May 23, 2006, entitled PUSH-PULL EARPHONE DRIVER (LOUDSPEAKER), which is hereby incorporated fully herein by reference, is hereby claimed.

SUMMARY

A more detailed partial summary is provided below, preceding the claims. A squeeze-stretch (also called, herein push-pull) loudspeaker or driver, such as an electret, can operate in an active noise reduction (ANR) earplug application. Other embodiments of a squeeze-stretch loudspeaker operate in a similar way, although they will differ in detail. Other applications, such as earphones for communication and entertainment, will benefit from the compact arrangement of components in a squeeze-stretch design. Advantages include a greater sound output from a smaller package, a smooth frequency response, and because of the diaphragm arrangement, less sensitivity to vibration.

Earphone driver. Inventions disclosed herein are concerned with the design and construction of earphone loudspeakers, also known as drivers, as used in hearing aids, communications and entertainment systems, and ANR earplugs. A sketch of a representative ANR earplug that may be used with inventions disclosed herein is shown in FIG. 1. It shows the driver 102 embedded in an earplug 104 placed fairly deep within the ear canal 109, with a port 105, leading to the ear cavity 106 and eardrum 107. A microphone 110 is also embedded within the earplug, at its internal end, adjacent the ear canal close to the eardrum. This driver is excited by an electronic signal from the ANR circuitry 112. Drivers used in the other applications mentioned above might not be embedded in an earplug and might or might not be placed so deeply within the ear canal and would not necessarily be part of an active noise reduction system. The earplug 104 also has an external end, which emerges from the ear canal 109.

BRIEF DESCRIPTION OF THE FIGURES OF THE DRAWING

The inventions disclosed herein will be understood with regard to the following description, appended claims and accompanying drawings, where:

FIG. 4A is a schematic representation, in three parts, I, II and III of an arrangement and assembly of a squeeze stretch electret driver of an invention hereof, showing: I an assembly of electret diaphragms and grid electrodes in an exploded view; II the assembled diaphragms and electrodes, a driver can, rear cover and duct, in an exploded view; and III the same elements assembled;

FIG. 8A is a schematic representation in three parts, I, II and III, of an arrangement and assembly of a squeeze-stretch piezoelectric bimorph driver of an invention hereof, showing: I an assembly of bimorph plate diaphragms in an exploded view; II the assembled diaphragms, a driver can, rear cover and duct, in an exploded view; and III the same elements assembled;

DETAILED DISCUSSION

Figure 2:
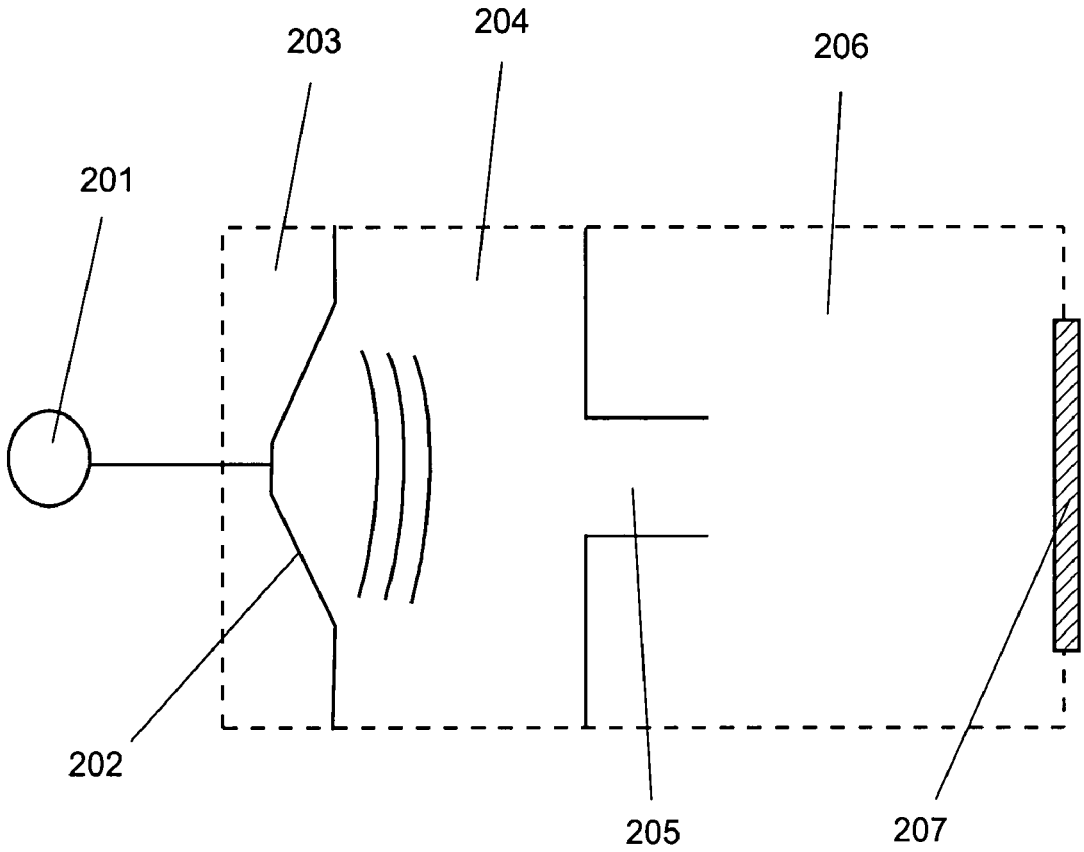
FIG. 2 is a schematic representation of a driver and its connection with an ear canal and an eardrum.

A generic arrangement that represents these applications as a driver in an ear canal is shown schematically in FIG. 2. A voltage source 201 causes a diaphragm 202 to vibrate and produce sound. As a result, pressure fluctuations are produced in the volume 203 behind the diaphragm 202 and in the volume 204 ahead of the diaphragm 202. The volume 204 has a port 205 that conducts the sound into the ear cavity 206. The pressure in the ear cavity 206 causes the eardrum 207 to vibrate and conduct sound to the middle and inner ear.

Figure 3A:
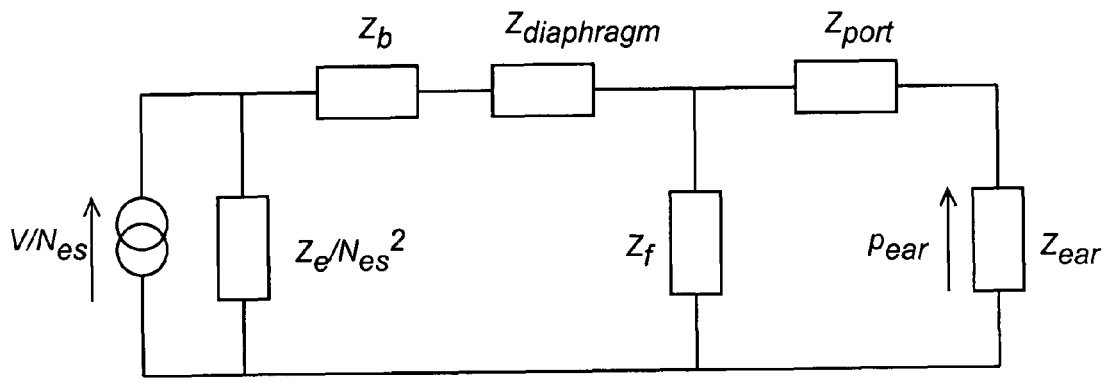
FIG. 3A is a schematic representation of a system circuit model of an electrostatic driver of an invention hereof.
Figure 3B:
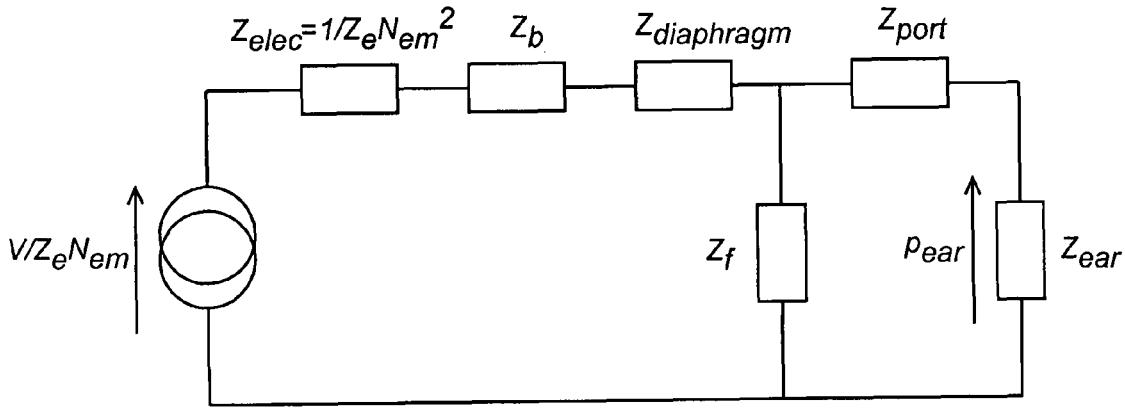
FIG. 3B is a schematic representation of a system circuit model of an electromagnetic driver of an invention hereof.

Driver design. Analysis of an earphone driver can be carried out using a circuit model as shown schematically in FIGS. 3A and 3B. FIG. 3A shows a model configuration for the class of electrostatic drivers, such as condenser/electret and piezoelectric transducers. FIG. 3B shows the model configuration for electromagnetic drivers, which includes moving coil, balanced armature, and magnetostrictive transducers.

These diagrams show how the cavity 203 behind the diaphragm 202 is represented by acoustic impedance $Z_b$, and the diaphragm 202 is represented by $Z_{diaphragm}$. The cavity 204 in front of the diaphragm 202 is represented by impedance $Z_f$ and the port 205 is represented by $Z_{port}$. The ear cavity 206 and the eardrum 207 are represented in combination by $Z_{ear}$. Diagrams like those shown in FIGS. 3A and 3B are used to calculate the sensitivity of a driver, characterized by the ratio of pressure at the eardrum to the applied signal voltage; $p_{ear}/V_s$.

FIGS. 2 and 3A and 3B show how the driver, i.e., the combination of diaphragm, front and rear cavities, and the port, produce sound in an ear cavity. Generally, the cavity 203 behind the diaphragm restricts or opposes the motion of the diaphragm. The cavity 204 in front of the diaphragm communicates the sound into the port and on into the ear cavity. The greatest difference between the types of drivers mentioned is the diaphragm. It is very light for an electret transducer, heavier for a balanced armature unit, and heavier still for a piezoelectric type. They also differ greatly in their electrical impedance characteristics. Electret and piezoelectric transducers are electrically a condenser. Balanced armature, moving coil, and magnetostrictive transducers are electrically a series combination of a resistor and an inductor.

Figure 4B:
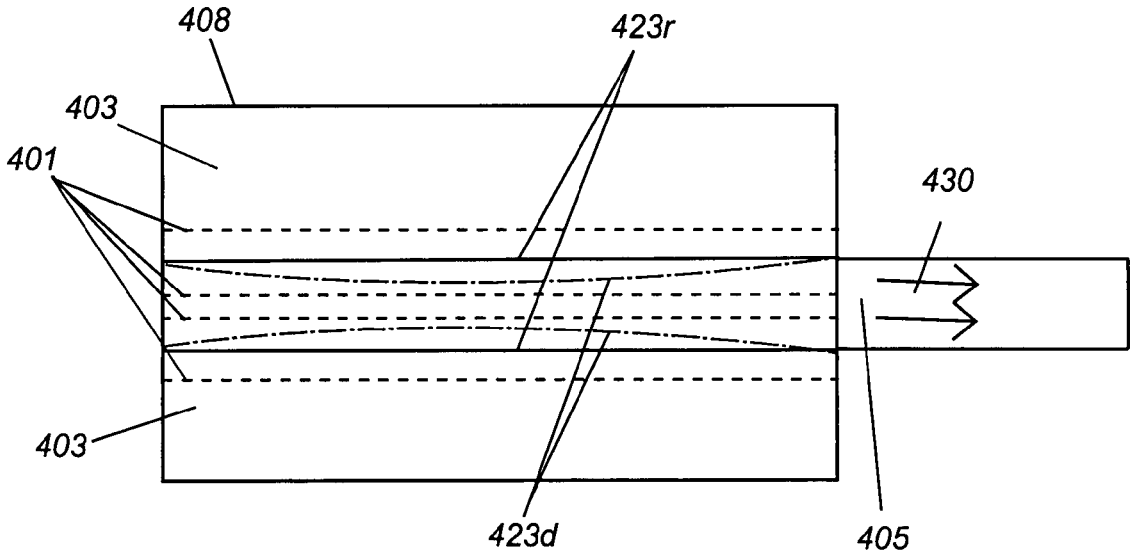
FIG. 4B is a schematic representation of the operation of an assembled squeeze-stretch electret driver of an invention hereof.

Advantages of a squeeze-stretch design. Drivers for this use should preferably have exterior dimensions small enough to fit within the ear canal and therefore the sizes of the diaphragm 202 and other internal components are restricted. For instance, an enclosure surrounding the diaphragms may be relatively elongated, but it should have at least two orthogonal minor dimensions of less than six mm. On the other hand, the pressure produced at the eardrum depends on how much air is pumped into the ear cavity. More air can be pumped if the diaphragm is larger. The diaphragm can be larger and more effective in a fixed space by making it a pair of diaphragms that work together in a squeeze-stretch manner, as illustrated in FIGS. 4A and 4B for the example of an electret driver. According to another description for squeeze-stretch, the cooperation of the two diaphragms may be thought of as alternately squeezing and stretching the undivided volume of air trapped between them. This configuration is also referred to herein at times as a push-pull configuration.

The squeeze-stretch electret driver sketched in FIG. 4A is one illustration of an invention disclosed here. Such an invention is for a class of miniature earphone drivers that use a pair of diaphragms, driven electrically in such a way that they cooperatively pump air through an exit port in and out of the ear canal into the ear cavity. This pumping results in pressure being produced at the eardrum resulting in an audible sound. A wide variety of electrostatic and electromagnetic transduction methods are possible.

It has been found beneficial to incorporate these transducers in a pair, within a single, pneumatically undivided, septum-free chamber or can, driving a pair of diaphragms in a squeeze-stretch, which may also be called a push-pull, manner. Diaphragms are pneumatically undivided, as used herein, if, when the two diaphragms move together toward and away from each other simultaneously, they squeeze out the air in the volume between them at one moment and draw in air the next as shown in FIG. 4B, and the squeezing out and drawing in is not impeded by the presence of any structures between the diaphragms.

The performance of the electret driver shown in FIGS. 4A and 4B is now illustrated. FIG. 3A is the relevant model for this type of driver where the elements are joined and represented as discussed above. In FIG. 3A, the voltage $V_s$ and the pressure $p_{ear}$ are the variables of interest and the other parameters noted in the figure are defined by system parameters, as illustrated by the values shown in Exhibit A, preceding the claims, System Parameters for the Squeeze-stretch Electret Driver (in mks units). These parameters and the analysis of FIG. 3A by ordinary circuit theory as presented for example in E. A. Guillemin, Introductory Circuit Theory, Chapman & Hall, Ltd., New York, 1953), are used to calculate the voltage to pressure transfer function for this transducer. The result of this calculation is shown in a graph in FIGS. 5A and 5B for three different values of the assumed ear cavity volume 206. The result indicates a fairly smooth frequency response and good sensitivity within the ear cavity. An example transducer has a length of 6 mm and a diameter of 5.5 mm. The driver must be small enough to fit within a human ear canal, which means, in general, that its diameter should be less than 7 mm, and preferably less than 6 mm. The length can be greater, but not by much.

Construction and operation of miniature drivers. The electret assemblies 402 shown in FIG. 4A are each composed of two grid electrodes 401 and an electret diaphragm 423, sandwiched there-between. Two electret assemblies 402, together constitute an electret/electrode pair assembly 400, and are sealed at their edges to the cylindrical container or can 408 as indicated. The space between these assemblies 402 and the can 408, enclosed by the rear cover 425 and front cover 427, is therefore a sealed volume 403, behind the diaphragm pair 400. The space 404 between the diaphragms 423 and the port 405 is pneumatically undivided because the electrode grids are screens that do not impede the drawing in and expelling out of air. The volume 404 is analogous to the cavity 204, ahead of the diaphragm. The entire driver assembly 450 is inserted into an ear canal 109 and cavity 106, such as is shown for a generic driver unit of an invention hereof 102, in FIG. 1. As the diaphragms 423 move toward each other in their squeeze-stretch (also called push-pull) mode from a relaxed position 423*r* to a deflected position as shown at 423*d*, in dashed line, the air 430 is expelled from the space 404 into port 405, where it is transmitted into the ear cavity (106 in FIG. 1, 206 in FIG. 2). Air flowing into the ear cavity 206 causes the air pressure $p_{ear}$ to rise and deflect the eardrum 107 (FIG. 1) 207 (FIG. 2). Air is, conversely, drawn into the space 404 when the diaphragms 423 move away from each other into an expanded, outwardly bowed, deflected position (which is not shown, to reduce clutter in the figure).

According to an alternative embodiment, rather than each assembly 402 having a diaphragm 423 sandwiched between two electrodes 401, each assembly can be a diaphragm 423, each with only one electrode grid, adjacent its outside surface that faces away from the other diaphragm. A third electrode grid 401 resides between the two diaphragms and is shared by both of them. These electrode grids are also composed of a screen, and are thus porous. Thus, even when an electrode grid physically divides the space between the two diaphragms, the diaphragms 423 are able to work together to draw air into the space between them, and to expel air therefrom. Thus, the space between the diaphragms is pneumatically undivided, as that phrase is used herein.

Figure 5A:
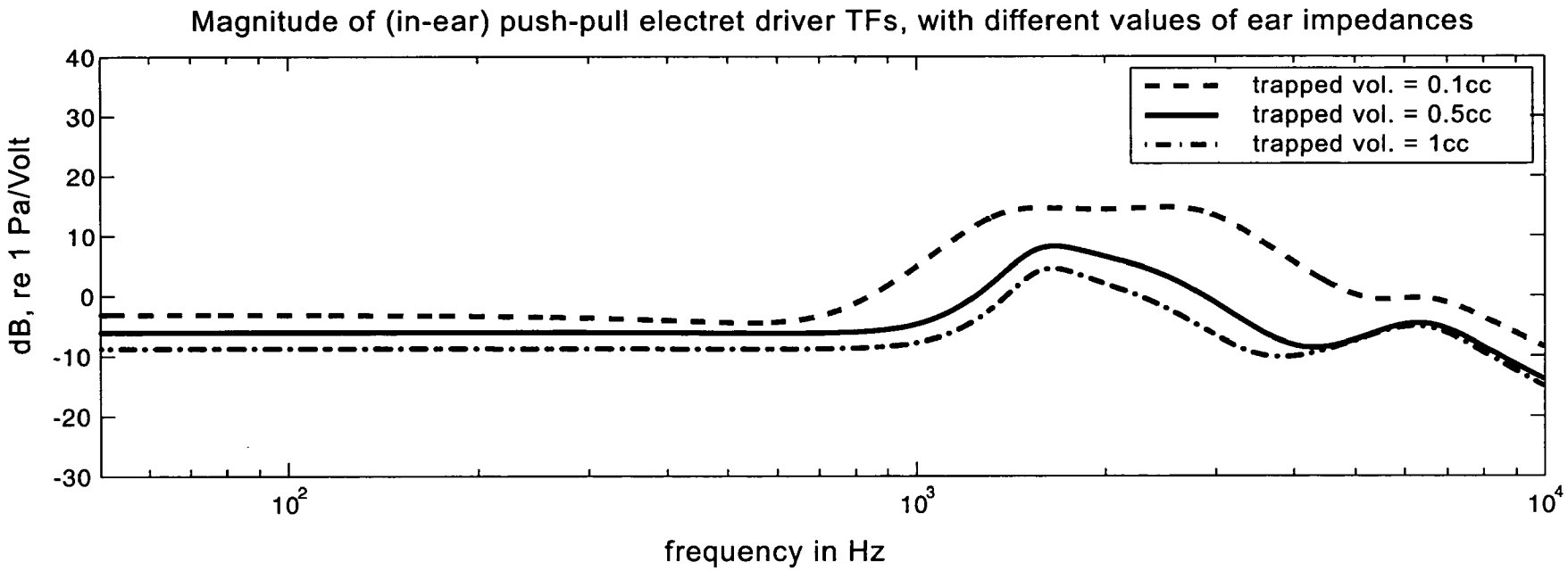
FIGS. 5A and 5B are, respectively, graphical representations of the sensitivity (transfer function) magnitude (FIG. 5A) and unwrapped phase (FIG. 5B) of a squeeze-stretch electret driver with different values of ear impedances, when loaded by a simple air cavity.
Figure 5B:
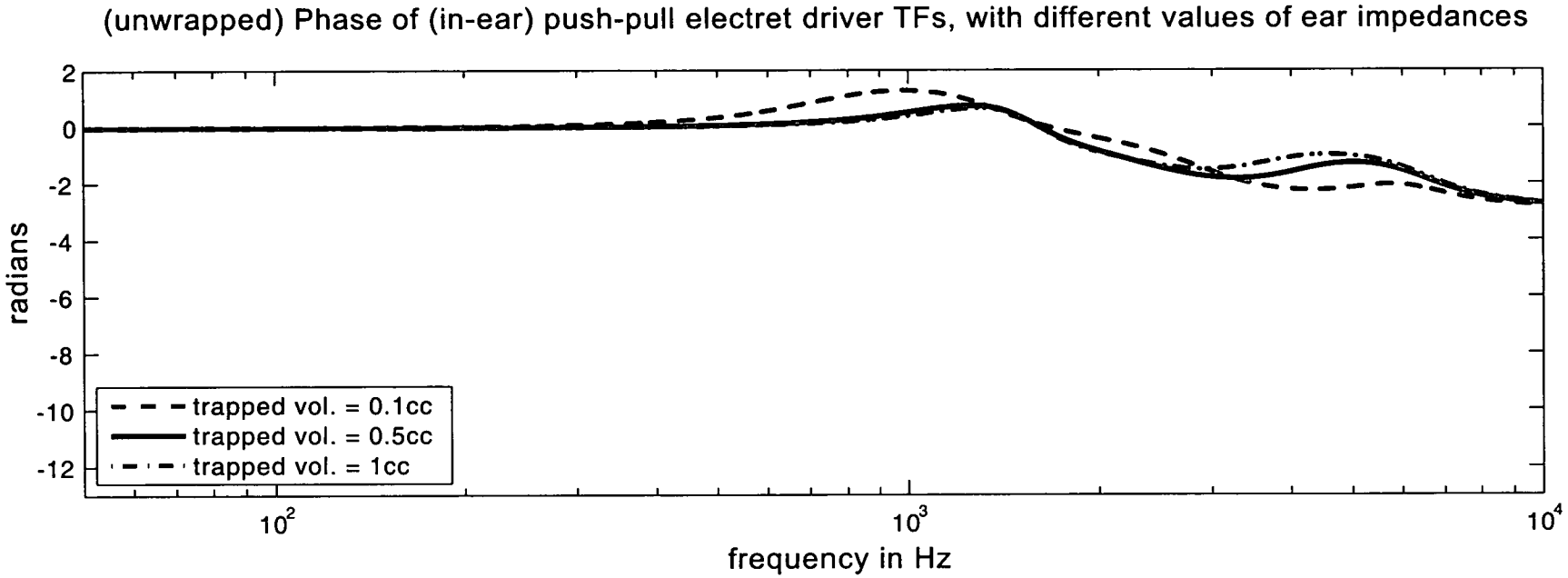

The process described in the preceding paragraph is what happens in a quasi-static or low frequency process. Since sound involves frequencies over a range from low to high, the actual dynamics of the interactions just described are included in the various impedance elements shown in FIGS. 3A and 3B and expressed for an electret driver in Exhibit A. The calculations using the model result in the transfer function, or sensitivity ratio $L=p_{ear}/V_s$ as shown in FIGS. 5A and 5B. This calculation shows that the transfer function depends on the volume of the ear cavity. If that volume is 0.5 cc for example, then the sensitivity is about 0 dB, or 1 Pa/volt. A comfortable sound level for listening to music or voice communications would be about 74 dB, which corresponds to a pressure of about 0.1 Pa. The driving voltage to achieve that pressure would be about 0.1 volt based on this calculation.

Another implementation of a squeeze-stretch transducer is a balanced armature design. Balanced armature products of this type that involve two drivers in separate cans or enclosures, working cooperatively, have been known, built and marketed. The prior, known balanced armature units as manufactured could not readily be placed in the same, undivided enclosure, without modification, for several reasons, including the manufacturing method used. When known balanced armature drivers are built, the armature ends up being magnetically stuck to one pole or the other of the magnet. The system is then adjusted (called tweaked by some in the industry), with an intruding magnetic field, to free the armature from the pole.

If two units are in the same, undivided enclosure, without any more hardware, it is not likely that both armatures would be freed by the same magnetic field adjustment. Thus, prior to an invention hereof, there had not been any notion to place two balanced armature units in one pneumatically undivided, septum-free can, in a squeeze-stretch cooperation.

Figure 6A:
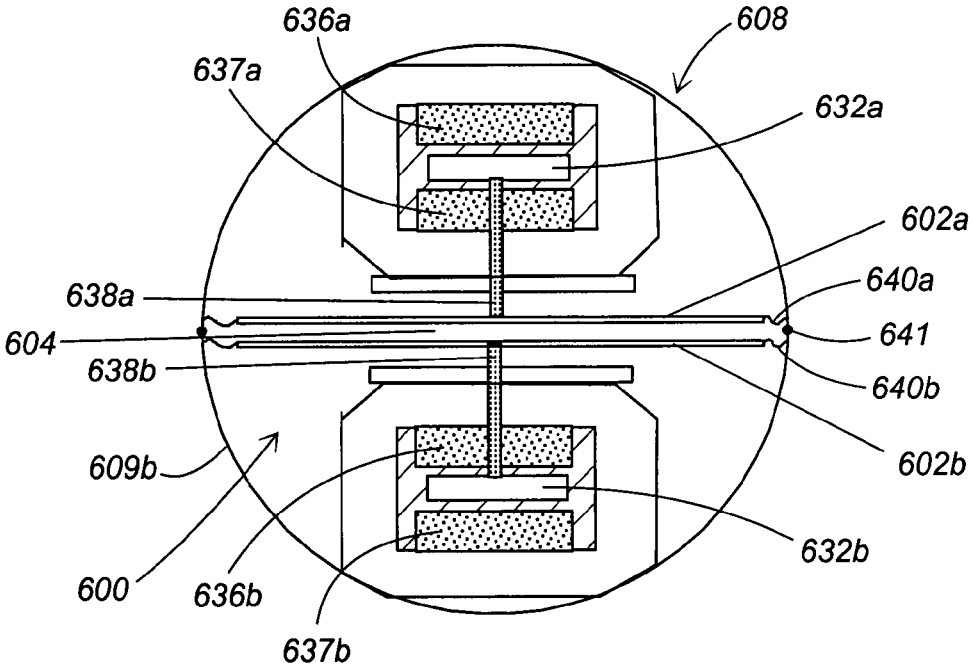
FIGS. 6A and 6B are a schematic representation of a squeeze-stretch balanced armature driver of an invention hereof, with FIG. 6A showing an end view, and FIG. 6B showing a side view.
Figure 6B:
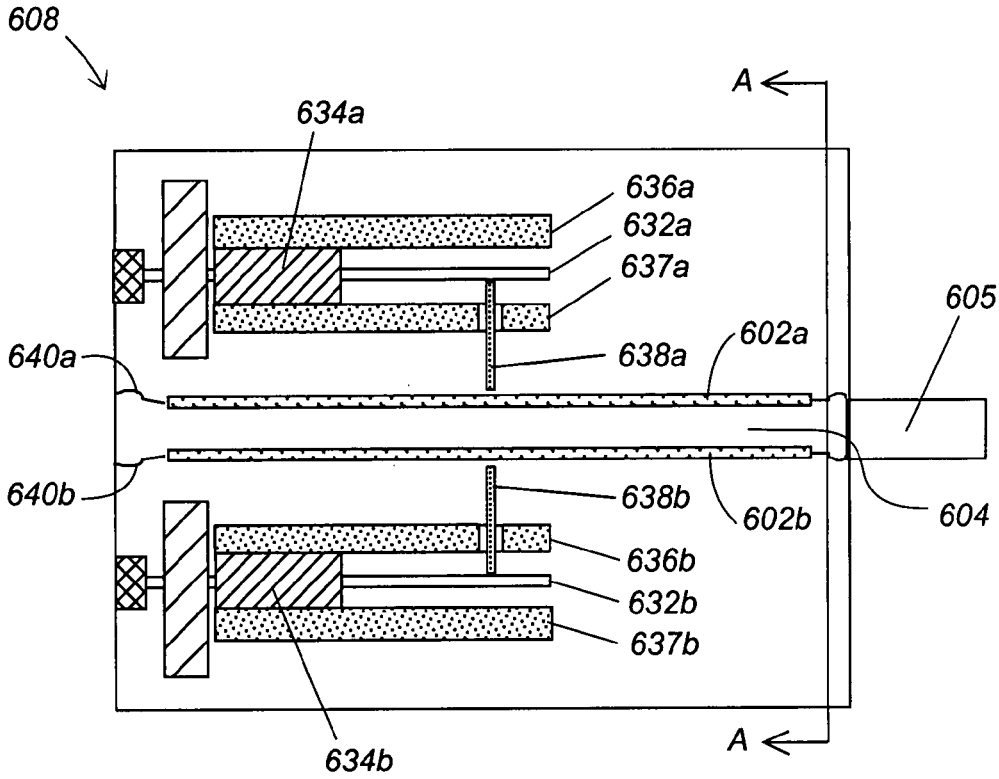

A squeeze-stretch assembly of an invention hereof is shown schematically in FIGS. 6A and 6B, with an end-view and a side cross-section. The two units (upper and lower, as shown) are constructed in separate sub-units, so the magnetization can be tweaked and the armatures can be freed separately, before the units are placed in the same, undivided can or housing 608, as shown.

Figure 7A:
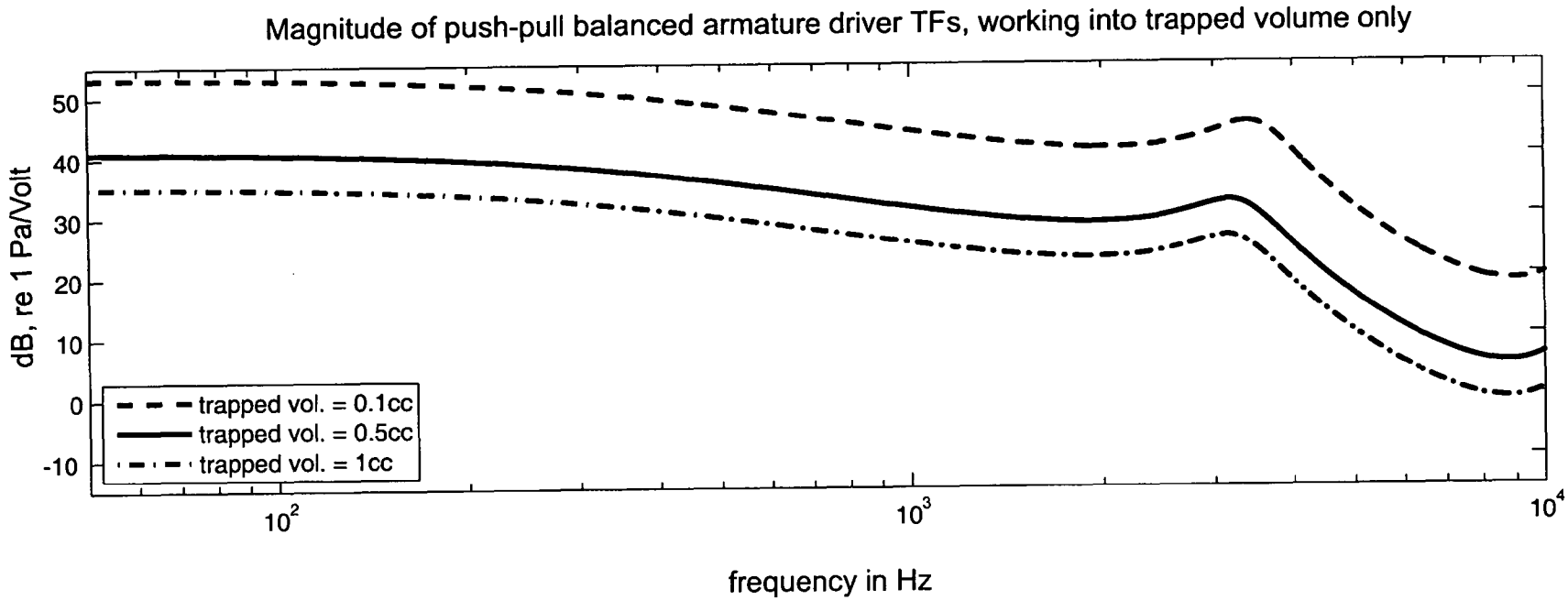
FIGS. 7A and 7B are, respectively, graphical representations of the sensitivity (transfer function) magnitude (FIG. 7A) and unwrapped phase (FIG. 7B) of a squeeze-stretch balanced armature driver of an invention hereof, working into trapped volume only.
Figure 7B:
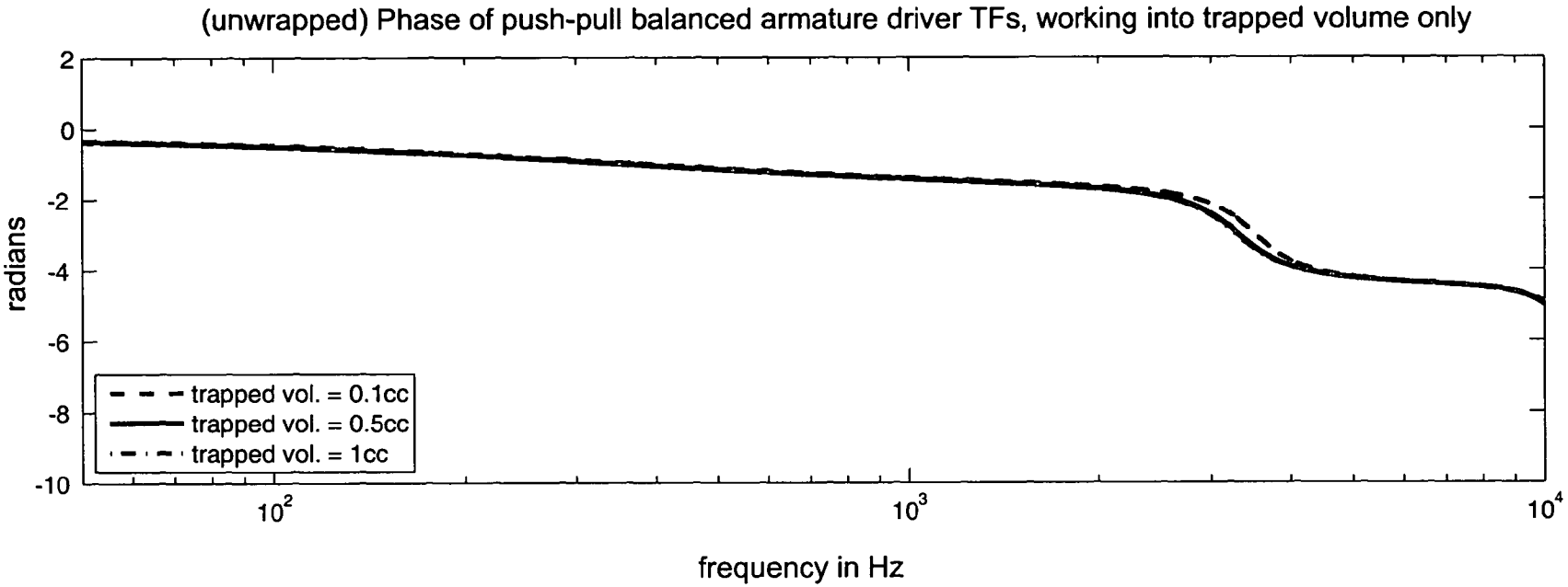

The calculated sensitivity for such a balanced armature squeeze-stretch driver is shown in FIG. 7, showing the magnitude above, and the phase below. This balanced armature design is quite sensitive, producing about 40 dB re (relative to) 1 Pa/volt (100 pascals/volt), in part because of the larger diaphragm area that the squeeze-stretch arrangement allows.

FIG. 6A shows, schematically an end view, and FIG. 6B shows in cross-sectional side view, a balanced armature driver 600 composed of two armatures, 632*a*, 632*b* secured together in a cylindrical housing 608. Each armature has a diaphragm, 602*a* or 602*b*. Each armature also includes a rare earth magnet 634*a*, 634*b* pole pieces 636*a*, 637*a*, 636*b*, 637*b*, and a drive pin 638*a*, 638*b*. A volume 604 of air is trapped between the diaphragms, and communicates with a shared port 605.

One form of sub-unit to facilitate magnetic field adjustment is to secure each armature individually into its own half-cylindrical enclosure 609*a*, 609*b*, with a relatively open rectangular face that is covered by the respective diaphragm, which is supported at its edges by a hinge 640*a*, 640*b*. The armatures are adjusted, or tweaked individually in their half cylindrical enclosures, which act as adjustment frames. The half-cylindrical enclosures are then brought together and welded or glued or otherwise sealed along their open edges 641 adjacent the hinges 640*a*, 640*b*. Other forms of securing may be used, and then the two secured armatures may be placed inside a unitary enclosure that does not need to be joined.

Figure 8B:
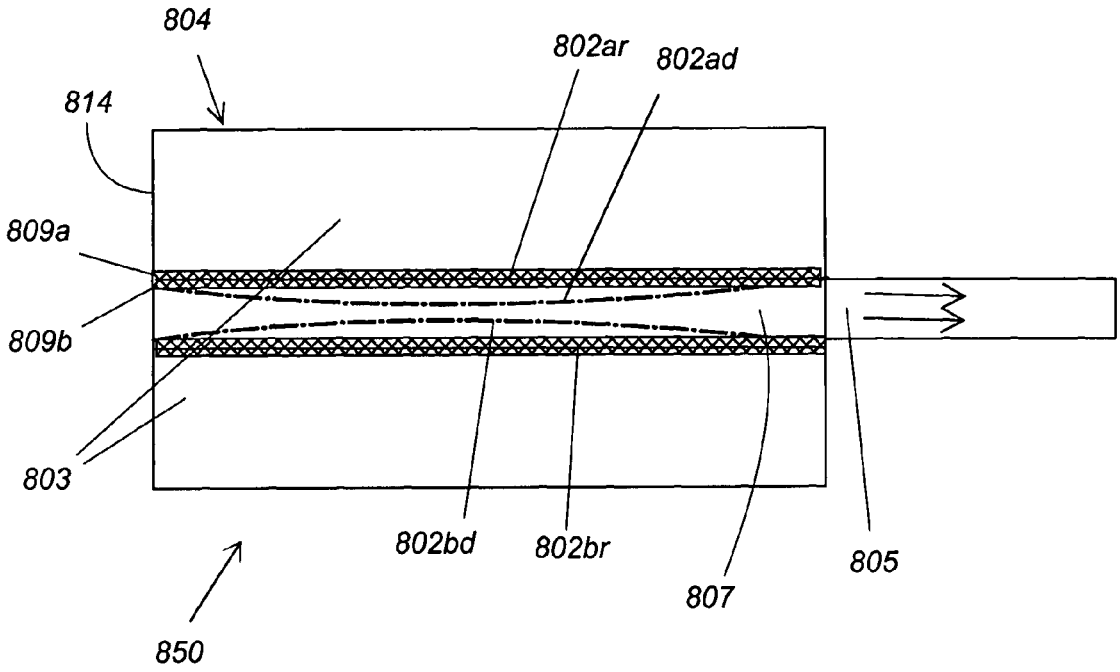
FIG. 8B is a schematic representation of the operation of an assembled squeeze-stretch piezoelectric bimorph driver or an invention hereof.

Another example of a squeeze-stretch arrangement that is a part of an invention hereof is a squeeze-stretch bimorph piezoelectric driver 850 sketched schematically in FIGS. 8A and 8B. Bimorph plates consist of a pair of piezoelectric plates (809*a* and 809*b*) bonded together to form a pair 802*a* and polarized so that the electric field causes one to contract while the other expands. The combination plate 802*a* then bends, which produces an amplified motion that can either serve as the diaphragm or drive a diaphragm. In FIG. 8A, a cylindrical can container 804 has a rear cover 814. Two bimorph combination plates (802*a* and 802*b*) are fitted within a frame 820 and operate together as an assembly 800 in a squeeze-stretch manner to squeeze the air 807 between them and force it out the port 805, which extends beyond the front cover 816, as is the case in the electret version also. Air cannot be forced out the rear because the frame 820 closes off the rearward facing boundary of the volume between the two diaphragms and there is a rear cover 814. A similar frame and duct arrangement can be used for an electret type embodiment of an invention hereof, as shown in FIGS. 4A and 4B. FIG. 8B shows the relaxed diaphragms 802*ar*, 802*br*, and the deflected diaphragms 802*ad* and 802*bd* (in dot-dashed line). As with the electret embodiment, the diaphragms also assume an outwardly bowed expanded position to draw in air, which is not shown to maintain simplicity in the figures.

Figure 9A:
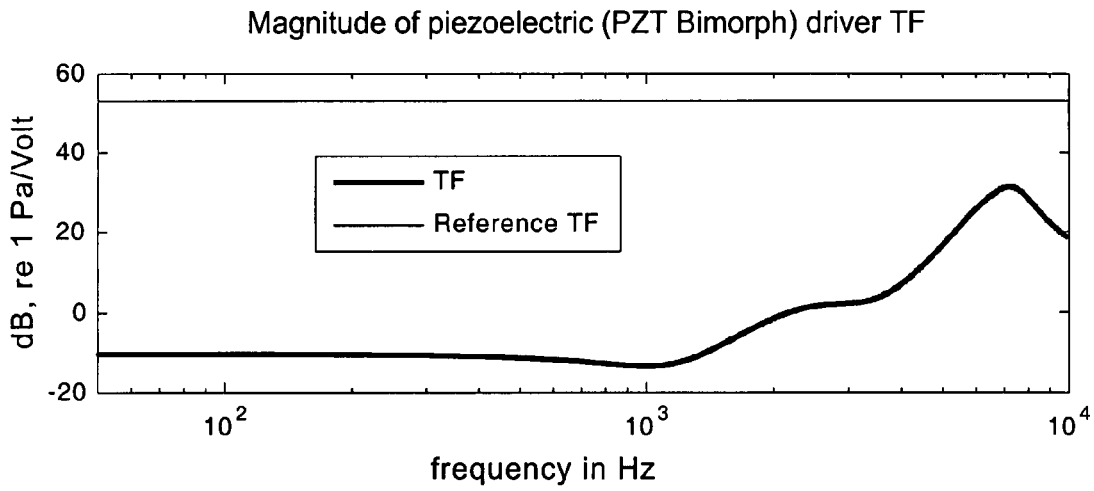
FIGS. 9A and 9B are, respectively, graphical representations of the sensitivity (transfer function) magnitude (FIG. 9A) and unwrapped phase (FIG. 9B) of a squeeze-stretch piezoelectric bimorph driver.
Figure 9B:
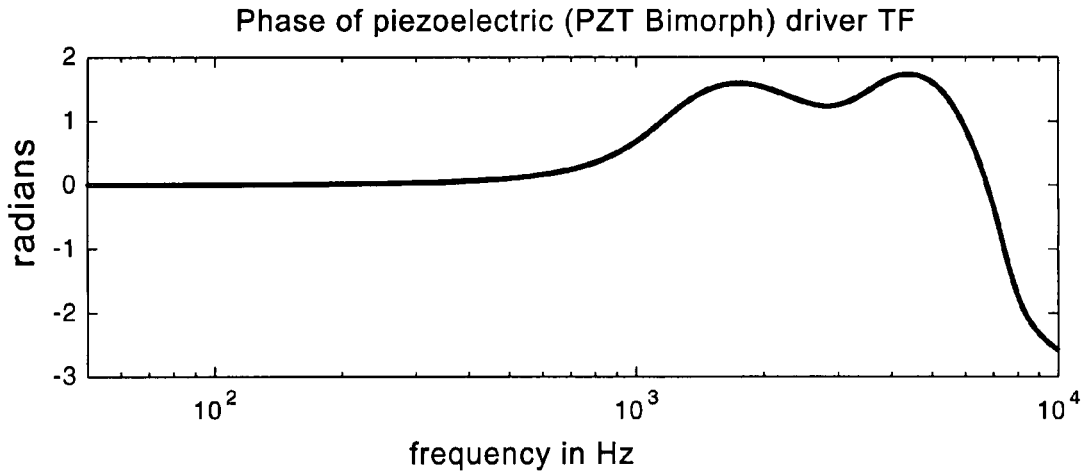

The sensitivity of a squeeze-stretch bimorph driver 850 has been calculated and is shown graphically in FIGS. 9A and 9B, which show the transfer function for the magnitude and the phase, respectively. At lower frequencies, the value is about 0 dB re 1 Pa/volt, or about 1 Pa/volt. This value is very close to that found for the electret driver. The exact sensitivity will depend on the thickness of the piezoelectric plates, the material used, and diaphragm area. One reason for the relatively good sensitivity of these electrostatic designs (the electret and the piezoelectric bimorph) is the relatively large diaphragm area provided by the squeeze-stretch arrangement.

EXAMPLE

Active Noise Control (ANR) Earplugs

As an example of the performance of a squeeze-stretch design, its application to ANR earplugs is described here. The transducer discussed is a squeeze-stretch electret design, but any other squeeze-stretch designs of a suitably small size, could be applied to this earplug and analyzed in a similar manner.

Figure 1:
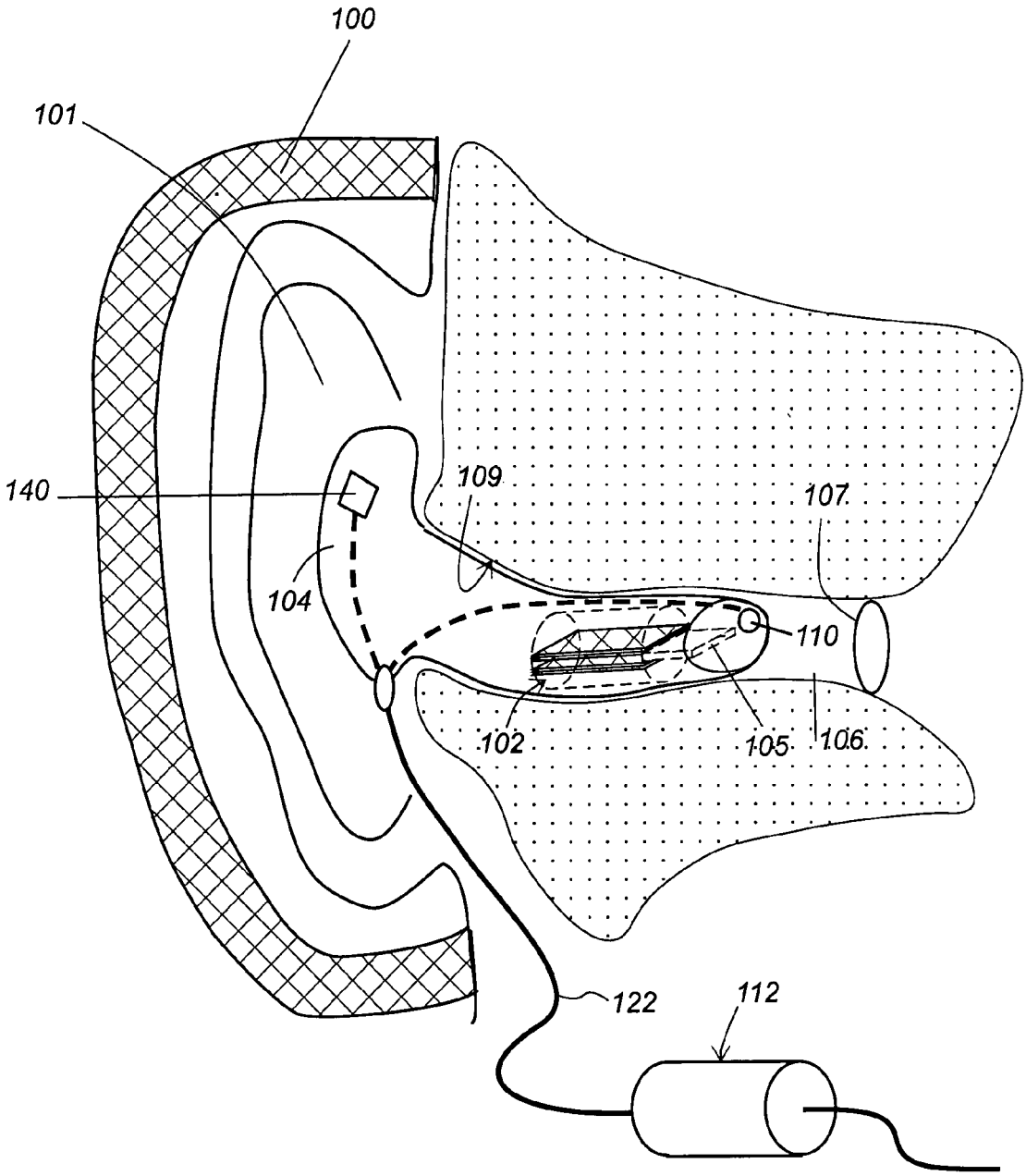
FIG. 1 is a schematic representation of an active noise reduction earplug of an invention hereof, embedded within an ear canal.

A general arrangement for an ANR earplug is shown in FIG. 1. A passive muff 100, which may have custom seals, surrounds an outer ear 101. A deep earpiece 104 lodges inside the ear canal 109 adjacent the second bend. Within the earpiece 104 or alternatively adjacent it and deeper inside the ear canal, is the squeeze-stretch driver 102 and a microphone 110. A wire 122 couples the driver 102 and microphone 110 to an electronics module 112, which provides power and which sends electronic control signals and which receives the microphone signal; processes it, and provides a processed signal to the driver 102. As wireless communication schemes, such as Bluetooth® and even wireless power transmission schemes, become smaller and more effective, a wireless channel may substitute for all or part of the wire.

The microphone 110 is very small, typically on the order of one to two mm in diameter. It would typically be embedded within the earpiece 104 so that it senses the pressure in the ear cavity 106. The duct 105, which acoustically couples the volume between the diaphragms to the air within the ear cavity 106 adjacent the ear drum 107, can be any suitable shape in cross-section, including rectangular or circular.

Figure 10A:
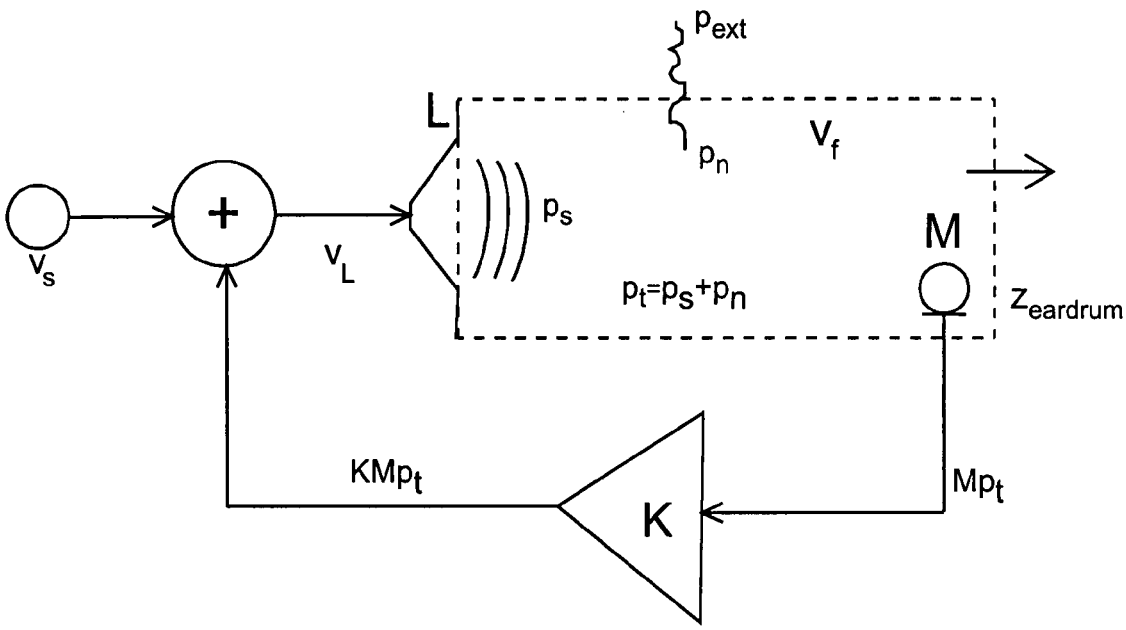
FIG. 10A is a schematic representation of a system diagram of an ANR earplug with a signal input at a driver.
Figure 10B:
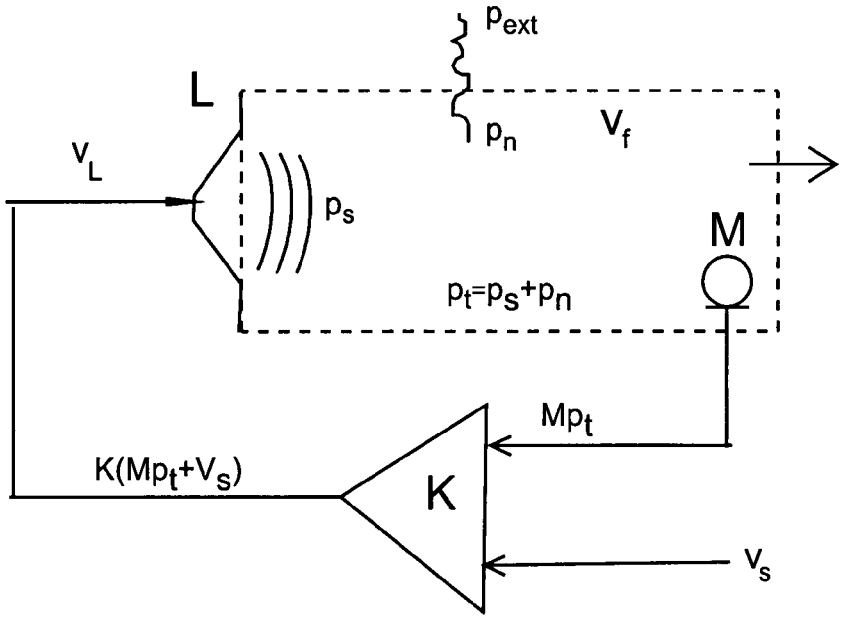
FIG. 10B is a schematic representation of a system diagram of an ANR earplug with a signal input at an op-amp.

The system diagram for this device is shown in FIGS. 10A and 10B, which show alternative designs. The diagram shows a signal voltage $V_s$ that contributes to the total voltage $V_L$ that excites the loudspeaker or driver to contribute to the total pressure in the ear cavity. The total pressure in the cavity is that contribution $p_s=V_L L$ plus the pressure due to intruding noise $p_n$.

The microphone M, also in the ear cavity, senses the total pressure $p_t=p_s+p_n$ with sensitivity M to produce an electrical signal $Mp_t$. This signal is passed through the high gain feedback amplifier K which has an output $KMp_t$. This signal is combined as shown in FIG. 10A to produce a total voltage input to the loudspeaker $V_L=V_s+KMp_t$. Therefore $$p_t=p_n+p_s=p_n+(KMp_t+V_s)L. \quad (1)$$

If we first consider the case where there is no signal voltage (Vs=0), then $$p_t(1-KLM)=p_n;\ p_t/p_n=(1-KLM)^{-1}. \quad (2)$$

ANR systems are typically designed so that the loop gain KLM is large so that the pressure $p_t$ at the ear due to noise is much smaller than $p_n$, the noise pressure that would be present if the feedback did not cancel it. When the loop gain is large, usually because K is large, then the noise reduction NR produced by the feedback (in dB) is $$NR=20\log(p_t/p_n)\approx-20\log|KLM|. \quad (3)$$

Figure 11:
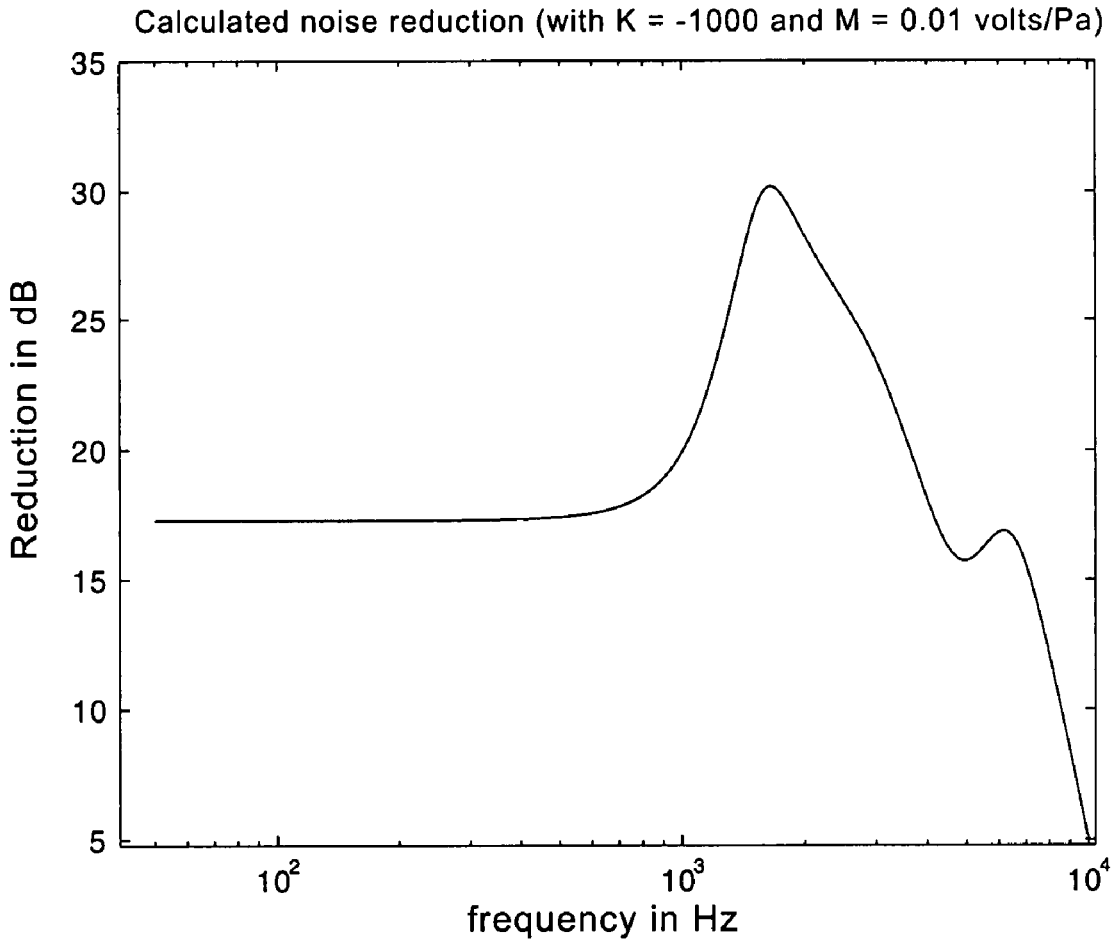
FIG. 11 is a graphical representation showing a calculated noise reduction when a squeeze-stretch electret driver is used in an ANR earplug system.

This noise reduction is graphed in FIG. 11 for some reasonable values of K and M and the value of L presented in FIGS. 5A and 5B. The reduction is about 17 dB over a frequency range from less than 100 Hz to about 1000 Hz, and then peaks near 1100 Hz. Thus, reduction of at least 10 dB is possible over a wide frequency range.

The pressure $p_s$ must be the same order of magnitude as $p_n$ in order to cancel $p_n$. In some applications the driver might be required to produce diaphragm motions that would lead to a pressure as much as 130 dB at the eardrum (if the intruding noise were not present also). Of course, such a pressure does not actually occur because it is canceling the external noise so as to reduce the pressure at the eardrum. A pressure level of 130 dB corresponds to a pressure fluctuation of 63 Pa. Using the loudspeaker sensitivity shown in FIGS. 5A and 5B, the voltage required to cancel 130 dB is graphed in FIG. 12. The voltage required is about 100 volts (+40 dB re 1 volt).

Figure 12:
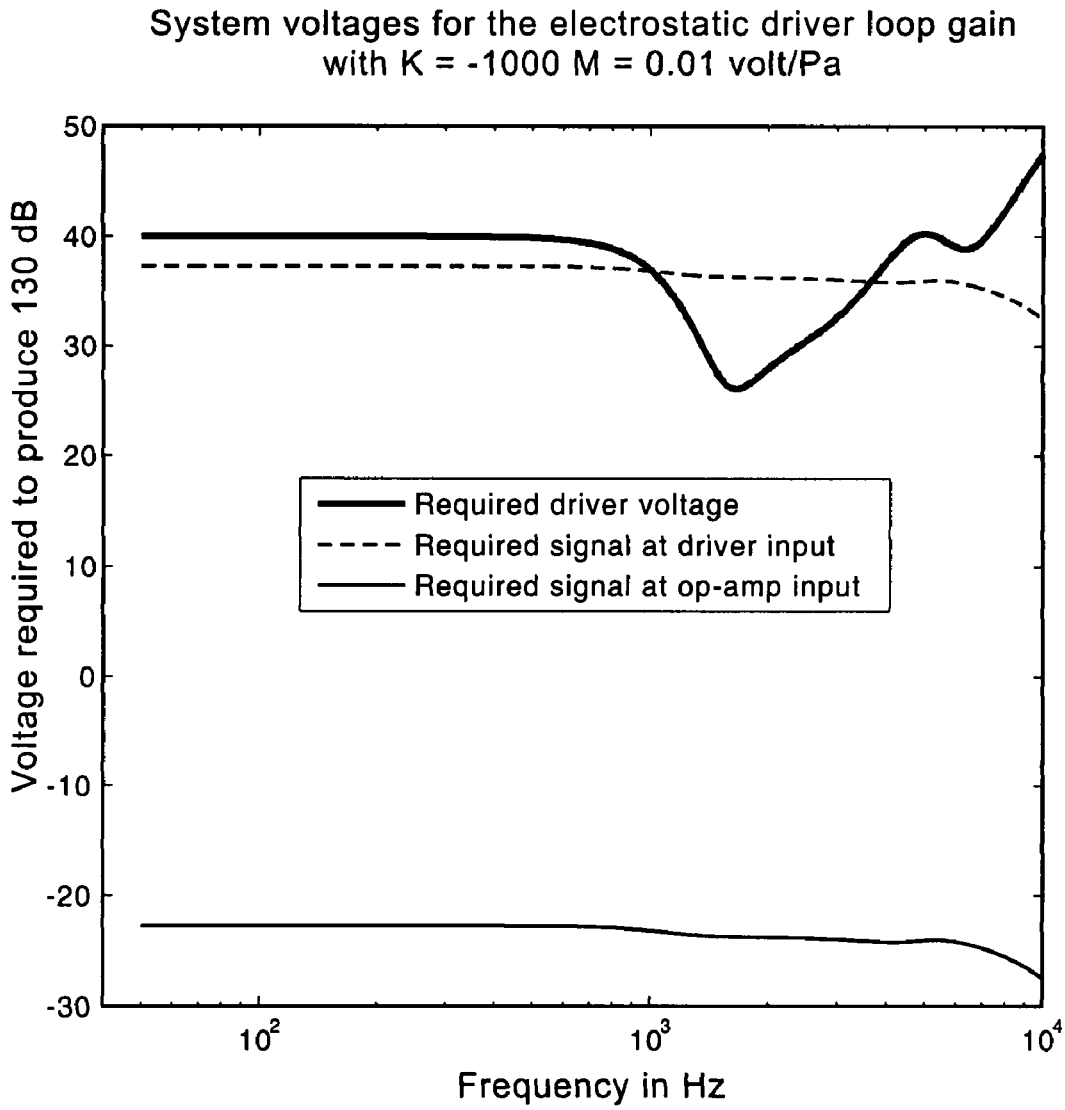
FIG. 12 is a graphical representation showing signal and noise canceling voltages for a squeeze-stretch electret driver of an invention hereof, as part of an ANR earplug system.

FIG. 12 also shows the signal voltage $V_s$ required to produce a sound level in the ear of 115 dB, which is fairly loud but perhaps necessary in situations where the background noise intruding into the ear is 130 dB, and the noise canceling provides 17 dB of reduction, as indicated in FIG. 11. Then even with cancellation, the noise level will be about 113 dB, and the signal level will be 115 Db, which is acceptable for understanding, but marginal.

If the signal voltage is introduced at the input to the feedback amplifier K, then the required voltage is reduced by the gain K of that component. The graph of FIG. 12 shows the voltage required to produce a signal level of 115 dB if the voltage $V_s$ is introduced at the input to K.

The system also has applications for use in low noise environments. In such a case, it may also be useful to include an additional microphone 140 (FIG. 1) that is external to the earpiece 104, and which would sense local sound, which could then be presented to the user through the pair of diaphragms. Such uses might include for hearing impaired users, or other situations, where it is desireable to use the earpiece and ear muff to eliminate local sound at times, but not at all times.

SUMMARY

The discussion in the preceding section shows how a squeeze-stretch electret loudspeaker or driver can operate in an ANR earplug application. The other embodiments of a squeeze-stretch loudspeaker will operate in a similar way, although they will differ in detail. Conversely, other applications such as earphones for communication and entertainment will benefit from the compact arrangement of components in a squeeze-stretch design. The advantages of this invention are a greater sound output from a smaller package, a smooth frequency response, and because of the diaphragm arrangement, less sensitivity to vibration.

According to a preferred embodiment, an invention hereof is an acoustic driver, comprising: a pair of diaphragms, each having at least one surface, the surfaces facing and spaced apart from each other and defining a volume there-between, arranged so that the diaphragms are free to move with respect to each other to squeeze and stretch air within the defined volume; an enclosure that surrounds the pair of diaphragms, all three orthogonal dimensions of the enclosure being, at most, six mm; a duct that pneumatically couples the defined volume with an environment that is external to the enclosure; and an electronic couple, that couples to the pair of diaphragms, arranged to couple also to a signal generator.

The pair of diaphragms may be electrostatic, or electromagnetic. Examples of electrostatic diaphragms include electret and piezoelectric bi-morph diaphragms. An example of an electromagnetic diaphragm is a balanced armature assembly.

According to a related embodiment, an invention hereof also includes a signal generator, operative to drive the diaphragms to squeeze and stretch air within the defined volume. Such an embodiment may also include a microphone adjacent the enclosure, electronically coupled to the signal generator. In an active noise reduction embodiment, the signal generator may be operative to drive the diaphragms to cancel at least some of any sound sensed by the microphone, and preferably, reducing the noise by at least ten db as compared to the situation without the microphone and feedback.

With still another related embodiment, the driver comprises an elongated earplug having an internal and an external end, shaped and sized to fit within a human ear canal, with the internal end adjacent a second bend in the ear canal, the pair of diaphragms being located within the earplug, between the external and the internal ends, with the duct opening at the internal end into an ear cavity. This embodiment may further comprise a microphone, adjacent the internal end of the earplug, electronically coupled to the signal generator.

Yet another embodiment of an apparatus of an invention hereof is an acoustic driver, comprising: a pair of diaphragms, each having at least one surface, the surfaces facing and spaced apart from each other and defining an undivided volume there-between, arranged so that the diaphragms are free to move with respect to each other to squeeze and stretch air within the defined volume; an enclosure that surrounds the pair of diaphragms; a duct that pneumatically couples the defined volume with an environment that is external to the enclosure; and an electronic couple that couples to the pair of diaphragms, arranged to couple also to a signal generator.

With variations related to this undivided volume embodiment, the pair of diaphragms may comprise a pair of electrostatic or electromagnetic diaphragms.

An embodiment related to this further comprises a signal generator, operative to drive the diaphragms to squeeze and stretch air within the defined volume.

According to still another related embodiment, as with the embodiment specified to be smaller than 6 mm along any orthogonal dimension, an acoustic driver may further comprises an elongated earplug having an internal and an external end, shaped and sized to fit within a human ear canal, with the internal end adjacent a second bend in the ear canal, the pair of diaphragms being located within the earplug, between the external and the internal ends, with the duct opening at the internal end.

With or without the earplug, these related embodiments may include a microphone, adjacent the enclosure, (near the internal end in the case of the earplug) that is electronically coupled to the signal generator The signal generator may be beneficially operative to drive the diaphragms to cancel at least some of the sound sensed by the microphone, and in particular so that the signal sensed by the microphone is reduced by at least 10 db as compared to what would be present without the microphone and feedback.

Still another embodiment of an invention hereof is a method of assembling an acoustic driver comprising: a pair of balanced armature assemblies, each of which drive a diaphragm, each diaphragm having at least one surface, the surfaces facing and spaced apart from each other and defining a volume there-between, arranged so that the diaphragms are free to move with respect to each other to squeeze and stretch air within the defined volume; a single enclosure that surrounds the pair of diaphragms, and an electronic couple, that couples to the pair of diaphragms, arranged to couple also to a signal generator, each armature assembly also including a frame arranged so that the armature can be freed from magnetic attachment to the pole before assembly into the enclosure. The method of assembling comprises: providing a pair of armature assemblies, with each armature being magnetically adhering to a pole of its respective assembly, each armature including an independent adjustment frame; applying a magnetic field to each individual armature, to free it from magnetic adherence to its respective pole, before placing the respective armature into an enclosed container; and then, enclosing each adjusted, freed, armature assembly, with its frame, within a single, pneumatically undivided container, arranging the diaphragms of each armature assembly facing and spaced apart from each other and defining a volume there-between, arranged so that the diaphragms are free to move with respect to each other to squeeze and stretch air within the defined volume.

Many techniques and aspects of the inventions have been described herein. The person skilled in the art will understand that many of these techniques can be used with other disclosed techniques, even if they have not been specifically described in use together. For instance, any of the transducers can be arranged to squeeze and stretch the air between them to produce the sound level required to reduce the amount of external noise to an acceptable level. Any can be used with any active noise reduction arrangements, whether known or yet to be developed. They can also be used in applications other than active noise reduction, for instance without a microphone. Similarly, if, in the future, a transducer that is not a dual membrane squeeze-stretch type transducer, but which can be made small enough to fit within a human ear canal, yet has enough power to generate adequate acoustic energy to reduce the noise level, then such a transducer can be used as configured herein with a microphone and circuitry, and is considered an invention hereof.

This disclosure describes and discloses more than one invention. The inventions are set forth in the claims of this and related documents, not only as filed, but also as developed during prosecution of any patent application based on this disclosure. The inventor intends to claim all of the various inventions to the limits permitted by the prior art, as it is subsequently determined to be. No feature described herein is essential to each invention disclosed herein. Thus, the inventor intends that no features described herein, but not claimed in any particular claim of any patent based on this disclosure, should be incorporated into any such claim.

Some assemblies of hardware, or groups of steps, are referred to herein as an invention. However, this is not an admission that any such assemblies or groups are necessarily patentably distinct inventions, particularly as contemplated by laws and regulations regarding the number of inventions that will be examined in one patent application, or unity of invention. It is intended to be a short way of saying an embodiment of an invention.

An abstract is submitted herewith. It is emphasized that this abstract is being provided to comply with the rule requiring an abstract that will allow examiners and other searchers to quickly ascertain the subject matter of the technical disclosure. It is submitted with the understanding that it will not be used to interpret or limit the scope or meaning of the claims, as promised by the Patent Office's rule.

The foregoing discussion should be understood as illustrative and should not be considered to be limiting in any sense. While the inventions have been particularly shown and described with references to preferred embodiments thereof, it will be understood by those skilled in the art that various changes in form and details may be made therein without departing from the spirit and scope of the inventions as defined by the claims.

The corresponding structures, materials, acts and equivalents of all means or step plus function elements in the claims below are intended to include any structure, material, or acts for performing the functions in combination with other claimed elements as specifically claimed.

Exhibit A: System Parameters for a Squeeze-Stretch Electret Driver (mks Units)

% Properties of Air:

Rho=1.18; % density of air—kg/$m^3$ c=345; % speed of sound—meters/second

B_air=Rho*$c^2$; % bulk modulus of air—pascals or N/$m^2$

% Eps=8.86e−12; % permittivity of air—joules/$mv^2$

% Dimensions of Driver:

L_dr=7e−3; % driver length—meters

L_d=7e−3; % diaphragm length—meters w_d=4e−3; % driver width—meters h_d=4e−3; % driver height—meters Ad=L_d*w_d; % effective area of each driver diaphragm (two diaphragms)

V_d=L_dr*w_d*h_d; % driver volume

% Driver Internal Cavities:

w_R=4e−3; % width of cavity behind diaphragm—meters

L_R=7e−3; % length of cavity behind diaphragm—meters h_R=3.9e−3; % height of cavity behind diaphragm meters V_R=L_R*w_R*h_R; % volume of cavity behind diaphragm C_R=V_R/B_air; % compliance of cavity behind diaphragm Z_R=1./(s*C_R); % acoustical impedance of cavity behind diaphragm V_f=V_d−V_R; % volume forward of driver C_f=V_f/B_air; % acoustical compliance of forward volume Z_f=1./(s*C_f); % acoustical impedance of forward volume % Acoustical Elements:

L_port=5e−3; % length of duct port—meters w_port=4e−3; % width of duct port—meters h_port=1e−4; % height of duct port—meters A_port=w_port*h_port; % cross-sectional area of port duct Eta_port=0.2; % loss factor port and cavity resonance—dimensionless M_port=Rho*L_port*(1−j*Eta_port)/A_port; % acoustic mass of port, with damping % Diaphragm Parameters:

h=12e−6; % thickness of driver diaphragm—meters dg=50e−6; % diaphragm to electrode distance—meters sigma=4e−4; % surface charge density on the electret diaphragm—meters Nes=dg/sigma; % use this when surface electret charge density is known Ten=10; % Membrane tension—N/m Rho_d=1500; % density of diaphragm material—kg/$m^3$ c_d=3000; % longitudinal wavespeed in diaphragm material—m/sec Ed=Rho_d*c_d$^2$; % modulus of diaphragm material—pascals Eta_d=0.2; % mechanical loss factor of diaphragm—dimensionless Cd=2*(4/pi$^4$)*Ad$^3$*(1−j*Eta_d)/(Ten*(L_d$^2$+w_d$^2$)); % acoustic compliance of diaphragm pair as a membrane under tension—m$^3$/pascal

What is claimed is:

1. An acoustic driver, comprising:

a. a pair of diaphragms, each having at least one surface, the surfaces facing and spaced apart from each other and defining a volume there-between, arranged so that the diaphragms are free to move with respect to each other to squeeze and stretch air within the defined volume;

b. an enclosure that surrounds the pair of diaphragms, all three orthogonal dimensions of the enclosure being, at most, six mm;

c. a duct that pneumatically couples the defined volume with an environment that is external to the enclosure; and d. an electronic couple, that couples to the pair of diaphragms, arranged to couple also to a signal generator.

2. The acoustic driver of claim 1, the pair of diaphragms comprising a pair of electrostatic diaphragms.

3. The acoustic driver of claim 2, the electrostatic diaphragms comprising electret assemblies.

4. The acoustic driver of claim 2, the electrostatic diaphragms comprising piezoelectric bimorph assemblies.

5. The acoustic driver of claim 1, the pair of diaphragms comprising a pair of electromagnetic diaphragms.

6. The acoustic driver of claim 5, the electromagnetic diaphragms comprising balanced armature assemblies.

7. The acoustic driver of claim 1, further comprising a signal generator, operative to drive the diaphragms to squeeze and stretch air within the defined volume.

8. The acoustic driver of claim 7, further comprising an elongated earplug having an internal and an external end, shaped and sized to fit within a human ear canal, the pair of diaphragms being located within the earplug, between the external and the internal ends, with the duct opening at the internal end.

9. The acoustic driver of claim 7, further comprising a microphone, adjacent the enclosure, electronically coupled to the signal generator.

10. The acoustic driver of claim 8, further comprising a microphone, adjacent the internal end of the earplug, electronically coupled to the signal generator.

11. The acoustic driver of claim 10, the signal generator operative to drive the diaphragms to cancel at least some of any sound sensed by the microphone.

12. The acoustic driver of claim 11, the signal generator configured to drive the diaphragms to reduce sound sensed by the microphone by at least 10 db.

13. An acoustic driver, comprising:

a. a pair of diaphragms, each having at least one surface, the surfaces facing and spaced apart from each other and defining a pneumatically undivided volume there-between, arranged so that the diaphragms are free to move with respect to each other to squeeze and stretch air within the defined volume;

b. an enclosure that surrounds the pair of diaphragms;

c. a duct that pneumatically couples the defined volume with an environment that is external to the enclosure; and d. an electronic couple that couples to the pair of diaphragms, arranged to couple also to a signal generator.

14. The acoustic driver of claim 13, the pair of diaphragms comprising a pair of electrostatic diaphragms.

15. The acoustic driver of claim 13, the pair of diaphragms comprising a pair of electromagnetic diaphragms.

16. The acoustic driver of claim 13, further comprising a signal generator, operative to drive the diaphragms to squeeze and stretch air within the defined volume.

17. The acoustic driver of claim 13, further comprising an elongated earplug having an internal and an external end, shaped and sized to fit within a human ear canal, the pair of diaphragms being located within the earplug, between the external and the internal ends, with the duct opening at the internal end.

18. The acoustic driver of claim 17, further comprising a microphone, adjacent the internal end of the earplug, electronically coupled to the signal generator.

19. The acoustic driver of claim 18, the signal generator operative to drive the diaphragms to cancel at least some of the sound sensed by the microphone.

20. A method of assembling an acoustic driver comprising: a pair of balanced armature assemblies, each of which drive a diaphragm, each diaphragm having at least one surface, the surfaces facing and spaced apart from each other and defining a volume there-between, arranged so that the diaphragms are free to move with respect to each other to squeeze and stretch air within the defined volume; a single enclosure that surrounds the pair of diaphragms, and an electronic couple, that couples to the pair of diaphragms, arranged to couple also to a signal generator, the method of assembling comprising:

a. providing a pair of armature assemblies, each of which comprising an armature and a pole and an adjustment frame arranged to retain the armature assembly while the pole is magnetically adjusted, with each armature being magnetically adhering to a pole of its respective assembly;

b. applying a magnetic field to each individual armature, independently, thereby freeing each armature from adherence to its respective pole; and c. subsequent to the freeing step, combining each freed armature assembly, within its frame, in a container, arranging the diaphragms of each armature assembly facing and spaced apart from each other and defining a pneumatically undivided volume there-between, arranged so that the diaphragms are free to move with respect to each other to squeeze and stretch air within the defined volume.

* * * * *